US012372324B2

(12) United States Patent
Laboccetta

(10) Patent No.: US 12,372,324 B2
(45) Date of Patent: Jul. 29, 2025

(54) MODULAR HYBRID SPEARGUN

(71) Applicant: Mark Laboccetta, Wilmington, NC (US)

(72) Inventor: Mark Laboccetta, Wilmington, NC (US)

( * ) Notice: Subject to any disclaimer, the term of this patent is extended or adjusted under 35 U.S.C. 154(b) by 0 days.

(21) Appl. No.: 18/089,419

(22) Filed: Dec. 27, 2022

(65) Prior Publication Data

US 2023/0213304 A1 Jul. 6, 2023

Related U.S. Application Data

(60) Provisional application No. 63/295,497, filed on Dec. 30, 2021.

(51) Int. Cl.
*F41B 7/04* (2006.01)
*A01K 81/00* (2006.01)
*F41B 7/00* (2006.01)

(52) U.S. Cl.
CPC ..... *F41B 7/04* (2013.01); *F41B 7/003* (2013.01)

(58) Field of Classification Search
CPC .. F41B 7/04; F41B 7/043; F41B 7/046; F41B 11/83; F41B 7/003; A01K 81/00
USPC ..... 124/16, 17, 20.1, 20.3, 21, 22, 35.1, 84, 124/27; 43/6
See application file for complete search history.

(56) References Cited

U.S. PATENT DOCUMENTS 2,267,065 A * 12/1941 Wilen ..... A01K 81/00 124/40
2,522,060 A * 9/1950 Ridland ..... A01K 81/00 124/80
2,818,849 A * 1/1958 McKay ..... F41B 7/04 124/31
2,900,972 A * 8/1959 Marsh et al. ..... F41B 11/83 124/63
3,016,891 A * 1/1962 Ebeling ..... A01K 81/00 43/6
3,026,864 A * 3/1962 Gray ..... F41B 7/046 74/110
3,210,880 A * 10/1965 Grenier ..... A01K 81/00 43/6
3,262,441 A * 7/1966 Senne ..... F41B 7/04 124/22
3,265,054 A * 8/1966 Gruenenfelder ..... A01K 81/00 124/40

(Continued)

FOREIGN PATENT DOCUMENTS

FR 2489953 A1 * 3/1982
WO WO-2024095044 A1 * 5/2024

OTHER PUBLICATIONS

Underwater crossbow with length adjustment—translation of FR 2489953 (Year: 1980).*

*Primary Examiner* — Alexander R Niconovich
(74) *Attorney, Agent, or Firm* — Olmsted Law, PLLC; Andrew Olmsted

(57) ABSTRACT

A system for underwater hunting contains a plurality of components which allow for customization of the speargun based on the user's needs and the conditions where a user is hunting. By allowing rapid additions or removals of certain components, the invention allow the user to easily modify the firing characteristics of the speargun, and thus target a wider range of prey across a wider range of environmental conditions than those designs currently available in the prior art.

5 Claims, 4 Drawing Sheets

(56) References Cited

U.S. PATENT DOCUMENTS 3,397,476 A * 8/1968 Weber ..... F41B 11/83 124/48
3,585,979 A * 6/1971 Hendricks ..... F41B 7/04 124/35.1
3,773,026 A * 11/1973 Romero ..... F41B 7/04 273/DIG. 7
3,949,731 A * 4/1976 Caso ..... A01K 81/00 124/31
4,759,336 A * 7/1988 Frain ..... F41A 19/20 124/31
4,895,128 A * 1/1990 Okada ..... A01K 81/00 124/31
4,962,747 A * 10/1990 Biller ..... F41B 7/046 124/40
5,145,740 A * 9/1992 Boykin ..... F41B 7/043 124/20.3
5,372,118 A * 12/1994 Schmidt, III ..... A01K 81/00 124/20.3
5,904,132 A * 5/1999 Biller ..... A01K 81/00 124/20.3
5,931,145 A * 8/1999 Oviedo-Reyes ..... F41B 5/12 124/20.3
6,811,503 B2 * 11/2004 May ..... F41B 7/04 473/578
8,387,602 B1 * 3/2013 Bruington ..... F41B 7/046 124/31
9,220,246 B1 * 12/2015 Roman ..... A01K 81/04
9,220,249 B1 * 12/2015 Bailey ..... A01K 81/00
9,414,578 B2 * 8/2016 Thornbrough ..... F41B 7/04
9,612,080 B1 * 4/2017 Hachigian ..... A01K 81/00
9,810,505 B2 * 11/2017 Hachigian ..... F41B 7/04
10,165,765 B1 * 1/2019 Ching ..... F41B 11/83
10,215,523 B1 * 2/2019 Hamilton ..... A01K 81/04
10,422,606 B2 * 9/2019 Zournatzis ..... F41B 7/04
10,648,766 B2 * 5/2020 Shaulov ..... F42B 6/02
11,519,688 B2 * 12/2022 Camarena-Vazquez ..... F41B 7/003
12,185,702 B2 * 1/2025 Borowski ..... A01K 81/04
2007/0034196 A1 * 2/2007 Sakuda ..... F41B 7/043 124/17
2009/0038600 A1 * 2/2009 Robinik ..... A01K 81/00 124/22

* cited by examiner

MODULAR HYBRID SPEARGUN

CROSS-REFERENCE TO RELATED APPLICATIONS

The present application claims priority of provisional application No. 63/295,497, filed Dec. 30, 2021.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable

FIELD OF THE INVENTION

The present invention generally relates to underwater spearguns. In particular, the present invention related to modular spearguns allowing for different configurations by the user allowing for a wider range of utility than those offered with fixed design.

BACKGROUND OF THE INVENTION

Spearfishing dates back thousands of years. Modern technological developments have allowed for participants (colloquially, "spearos") to target a wider range of prey across a wider range of conditions than ever before.

These developments have led to a high level of specialization readily apparent from review of the designs found within the prior art. For instance, "big game" spearguns feature reinforced muzzles, barrels and stocks to provide strength and support when users utilize powerful band configurations to target larger prey at distance in open water. At the other end of the spectrum, spearguns used to target smaller prey at shorter ranges, or in areas with environmental obstructions are often shorter, typically featuring less reinforcement and fewer bands. As there is less need for power at shorter ranges, there is less need for strength. The focus for these spearguns shifts towards greater mobility and greater weight savings.

As with any field where customization is desirable, the speargun industry is no different. Designs found in the prior art are typically of a fixed-feature type, wherein the user is limited to the configuration chosen by the manufacturer. This may lead to a user needing to purchase multiple spearguns to account for different hunting conditions, or lead the user to "make do" with one design in situations where alternatives are not available.

Therefore, there is a need for a speargun system wherein the user may customize the configuration of the speargun to account for multiple different hunting situations, the type of prey targeted, and other changing variables that would make such as system desirable. The goal of the present invention is to provide such a system and to remedy the deficiencies found within systems available in the prior art.

The inventor has performed a search of the prior art and believes the present invention is a new and useful invention for which patent protection is warranted.

SUMMARY OF THE INVENTION

Within the preferred embodiment, and the alternative embodiments disclosed herein, a speargun system with a plurality of customizable features is provided. Depending on the user's needs, the speargun can be configured to allow greater mobility and quicker aiming characteristics, or may easily converted to a higher-powered version by the addition of additional parts and features. The entire speargun may be quickly disassembled when so desired, allowing greater mobility when travelling, etc.

DETAILED DESCRIPTION OF THE INVENTION

Figure 1:
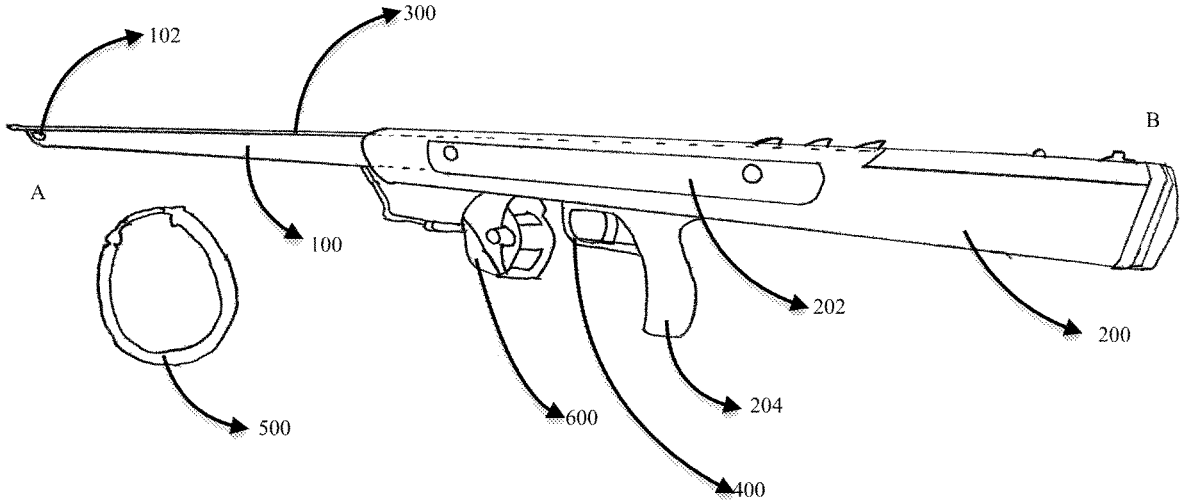
FIG. 1 is a side view of the present invention, as it would be seen in its completely assembled configuration.

Referring now to FIG. 1, there is shown the preferred embodiment of the present invention as assembled. At the anterior end A, there is shown a muzzle 102 attached to a barrel 100 leading into the stock 200 at the posterior end B. The stock 200 is generally defined as having a dorsal side, a ventral side, a left side, and a right side. Attached to the left and right sides of the stock 200 are a plurality of removable wings 202 which though not apparent from FIG. 1, may contain lead or any other material of suitable density to function as a ballast to help achieve the desired buoyancy underwater. The user may choose to utilize the wings 202 or not, depending on his/her particular needs.

Still referring to FIG. 1, the stock 200 features a handle 204 extending downward from the ventral surface of the stock 200 for the user to grasp when using the present invention. Located within the handle 204 is a trigger 400 which allows the user to fire the shaft 300 when s/he so desires.

Pictured separately within FIG. 1 is an exemplary band 500 for illustration purposes. In use, at least one band 500 would be positioned within the muzzle 102, pulled towards the posterior section and notched on the shaft 300 in order to propel the shaft 300 forward when the user desires. Though not required for operation or a required component of the preferred embodiment of the present invention, FIG. 1 also shows a reel 600 with rigging line, which could be attached to the ventral surface of the stock 200, should the user so desire. Users targeting larger prey at greater distances will often utilize a reel 600.

Figure 2:
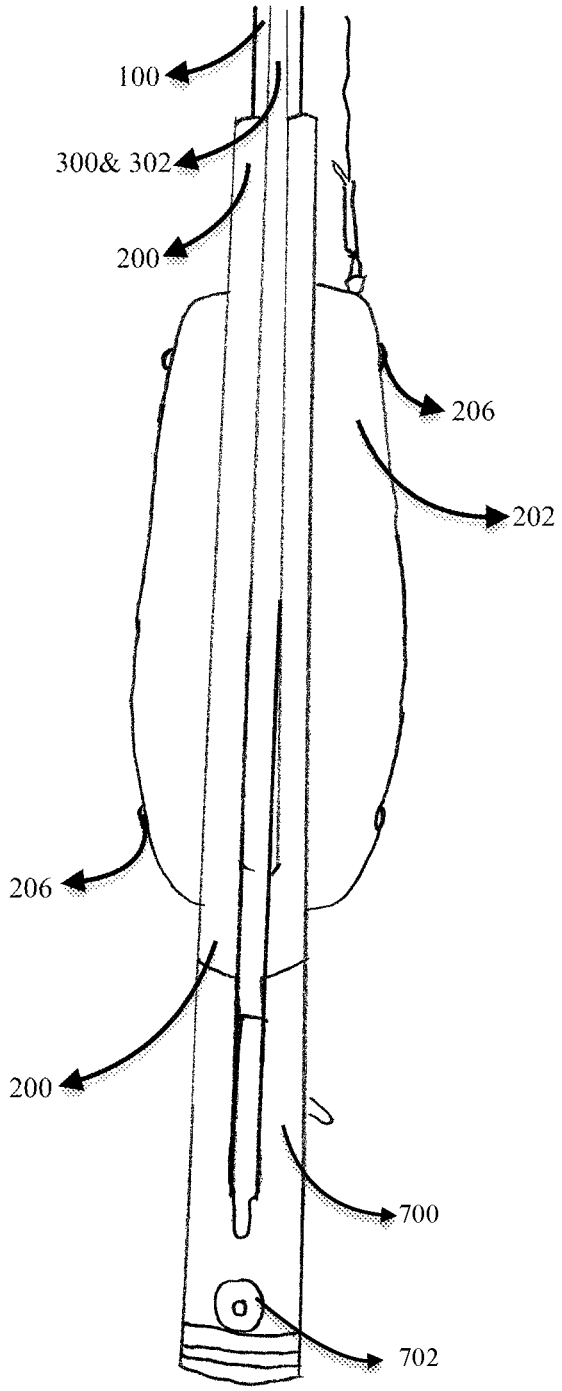
FIG. 2 is a top view of the present invention.
Figure 4:
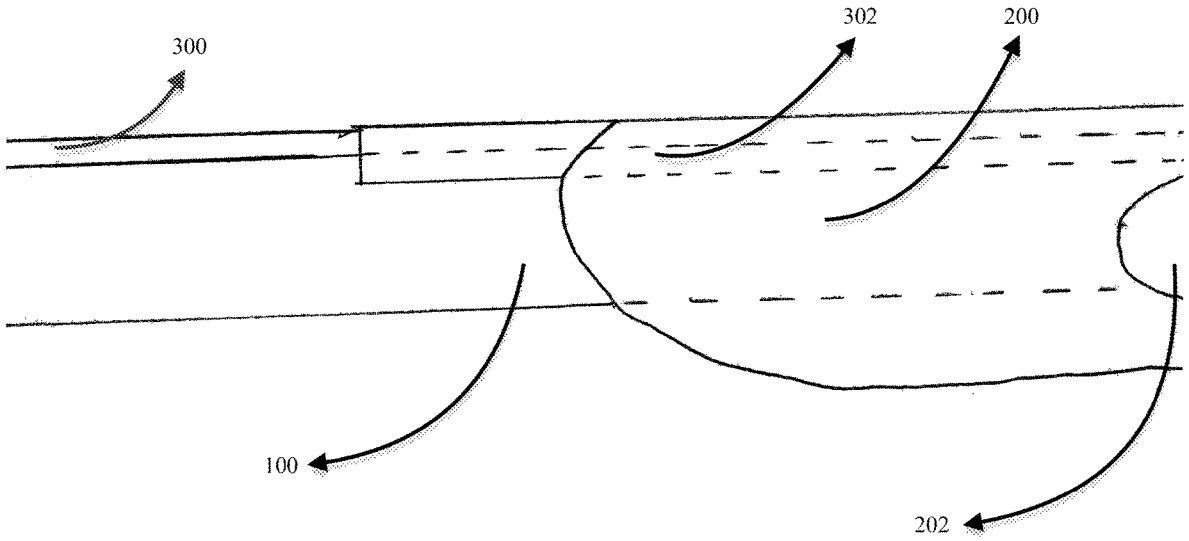
FIG. 4 is a cutaway view of a portion of the present invention.

Referring now to the dorsal view of the present invention as shown in FIG. 2, there is shown the stock 200 with a plurality of wings 202 extending from either side of the stock 200 and connected at a plurality of connection points 206. Also shown is the track 302 running traverse along the stock 200 and the barrel 100. The preferred embodiment of the present invention calls for the track 302 to be of a semi-enclosed design, known colloquially as an enclosed spear track. In such a design, the shaft 300 (depicted within FIG. 2 as within the track 302 itself) would be supported through a portion of the track 302 which is mated to the stock 200 along the barrel 100. FIG. 4 will further demonstrate the interplay between the shaft 300, track 302, barrel 100, and stock 200. Alternative embodiments of the present invention may utilize and open track 302 design, where the shaft 300 rests atop the track 302 prior to firing.

FIG. 2 shows the configuration of the wings 202 when the needs of the user call for use of the present invention to be assembled in the configuration allowing the greatest power. In this configuration, the additional mass of the wings 202 help to counteract the recoil that would be created by the use of additional bands 500 that would be needed for targeting prey at greater distances.

FIG. 2 also demonstrates the configuration of the hood 700 at the rear dorsal portion of the stock 200. Current inventions within the prior art do not allow for the user to easily access portions of the trigger and line release mechanisms without tools and are not particularly well-suited for adjustments in areas of use, such as in the water or on a boat. The preferred embodiment of the present invention seeks to remedy these deficiencies by allowing the user to remove a pin 702, which further allows the user to then lift the entire hood 700 from the stock 200. Once the hood 700 has been removed, the user may then access portions of the trigger 400 as needed to make quick adjustments in the field.

Figure 3:
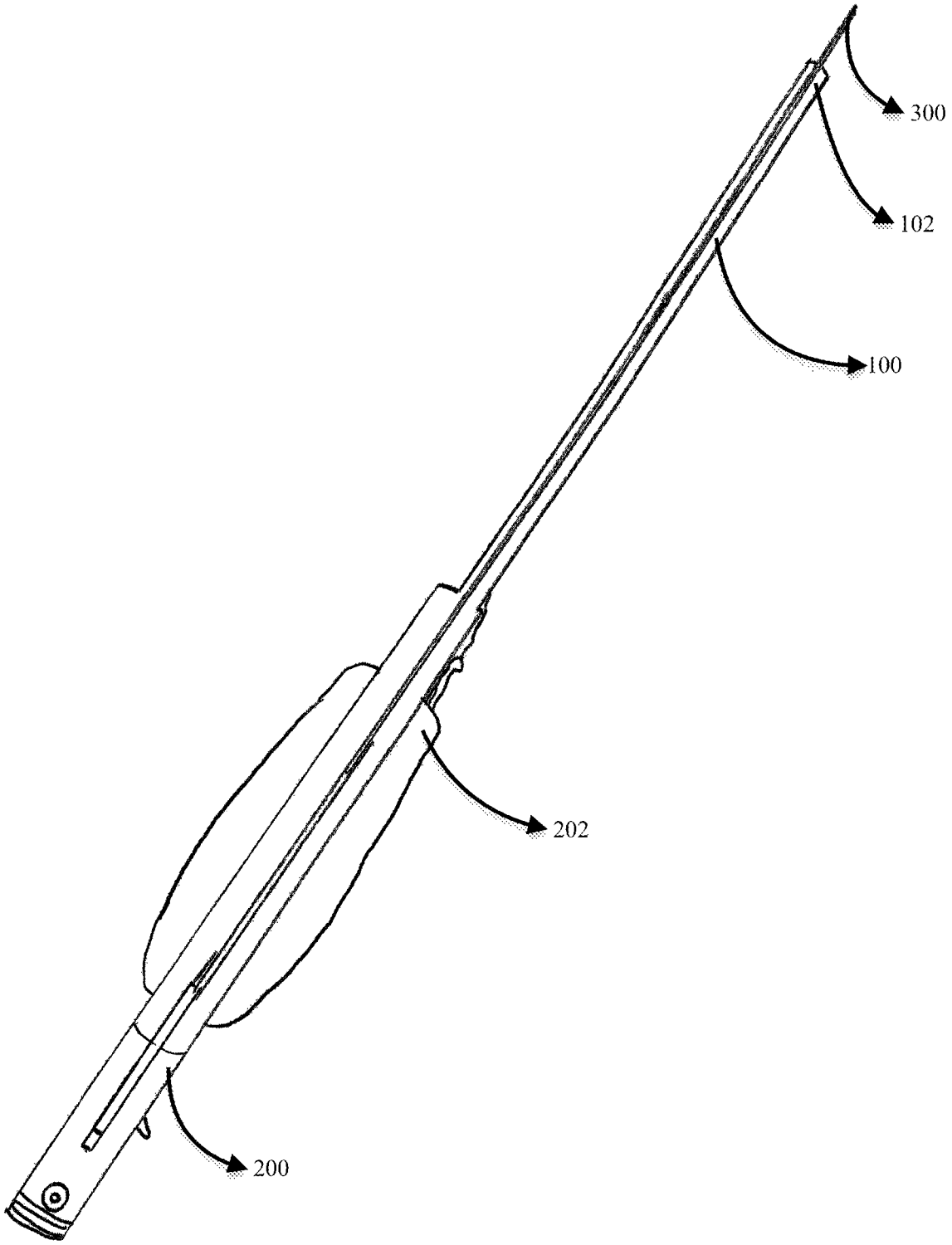
FIG. 3 is a perspective view of the present invention, as would be seen if viewed from the top in a completely assembled configuration.

FIG. 3 demonstrates a perspective view of the preferred embodiment of the present invention, in a configuration that would provide the greatest power and range, though with reduced maneuverability. In order to convert the present invention as shown in FIG. 3 to an alternative configuration allowing greater maneuverability, the user would remove the wings 202 from the stock 200 and would desire to use a shorter barrel 100, shorter shaft 300, and less powerful bands 500.

To reduce the barrel 100 length and power of the present invention after removal of the wings 202 from the stock 200, the user would then select a barrel 100 of shorter length, as well a lesser number of, or alternative band(s) 500. The modular nature of the present invention would also allow for the user to choose a longer barrel 100 and muzzle 102, as well as additional more powerful band(s) 500 if the user wished to instead increase the power and range of the present invention. Typically, the user would not remove the wings 202 from the stock 200 if power and range were to be increased, however the present invention supports a plurality of configurations to suit any particular user's needs.

The modular nature of the present invention also allows the user to utilize different length shafts 300 depending on his or her setup for the hunt. Typically, the user will want to utilize a shaft 300 extending only slightly past the muzzle 102.

Though not clearly depicted by the Figs., the present invention may allow the use of a locking mechanism where the barrel 100 terminates within, or at any place along, the stock 200.

FIG. 4 provides a close-up cutaway depiction of how the shaft 300 interacts with the barrel 100, as well as the track 302, and how all (100, 300, & 302) travel through the stock 200 when fully assembled. FIG. 4 also shows a configuration of the present invention with the wings 202 attached.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the described embodiment, method, and examples, but by all embodiments and methods within the scope and spirit of the invention as claimed.

What is claimed is:

1. A speargun, comprising:

a barrel removably inserted within a stock allowing for barrels of varying lengths to be utilized, a spear, the stock featuring a left side and a right side, each of said right side and said left side of the stock configured to receive a ballast unit, the ballast unit comprising at least one hydrodynamic ballast wing configured to be removably and directly attached to at least one of the right side and the left side of the stock such that the hydrodynamic ballast wing extends laterally from the stock and allows a user to increase or decrease an overall buoyancy of the speargun during use, a handle connected to the stock, a trigger housed within the handle, said trigger containing a mechanism for releasing the spear when activated, and a means for propelling the spear when the trigger is activated.

2. The speargun of claim 1, wherein the barrel features an elongated track on the barrel for direct insertion and retention of the spear.

3. A speargun, comprising:

an elongated barrel with a muzzle end and a stock end, said barrel featuring a retention track on an external surface of the barrel formed for directly receiving a spear, said spear configured to be retained within the retention track on the barrel until released by activation of a trigger mechanism by a user, a means for propelling the spear when the trigger mechanism is activated, a stock with a barrel end and a butt end, said stock featuring a handle containing a trigger mechanism, said stock further featuring at least one ballast attachment point, and at least one hydrodynamic ballast wing configured to be removably and directly attached to the at least one ballast attachment point on at least one of a right side and a left side of the stock such that the hydrodynamic ballast wing extends laterally from the stock and allows a user to increase or decrease an overall buoyancy of the speargun during use.

4. The speargun of claim 3, wherein the barrel is removably inserted within the stock allowing for insertion of barrels of varying lengths.

5. The speargun of claim 3, wherein the means for propelling the spear is at least one stretchable band.

* * * * *